US007585158B2

(12) United States Patent
Zeiser

(10) Patent No.: US 7,585,158 B2
(45) Date of Patent: Sep. 8, 2009

(54) PISTON ENGINE COMPRISING A PULSATION-REDUCING DEVICE

(75) Inventor: Horst Zeiser, Bubesheim (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 592 days.

(21) Appl. No.: 10/521,992

(22) PCT Filed: Jul. 9, 2003

(86) PCT No.: PCT/EP03/07422

§ 371 (c)(1),
(2), (4) Date: Sep. 27, 2005

(87) PCT Pub. No.: WO2004/009996

PCT Pub. Date: Jan. 29, 2004

(65) Prior Publication Data

US 2006/0096558 A1 May 11, 2006

(30) Foreign Application Priority Data

Jul. 19, 2002 (DE) ..... 102 32 983

(51) Int. Cl.
*F04B 1/00* (2006.01)

(52) U.S. Cl. ..... 417/271; 417/312; 91/487; 181/253

(58) Field of Classification Search ..... 417/269, 417/270, 271, 272, 273, 312, 540–544; 91/487, 91/486; 181/253
See application file for complete search history.

(56) References Cited

U.S. PATENT DOCUMENTS 4,362,223 A * 12/1982 Meier ..... 181/206

(Continued)

FOREIGN PATENT DOCUMENTS

DE 42 29 544 3/1993

(Continued)

OTHER PUBLICATIONS

Patent Abstract of Japan Publication No. 2002070728, published Mar. 8, 2002.

*Primary Examiner*—Devon C Kramer
*Assistant Examiner*—Dnyanesh Kasture
(74) *Attorney, Agent, or Firm*—Scully, Scott, Murphy & Presser, P.C.

(57) ABSTRACT

The invention relates to a piston engine comprising a rotatably mounted cylindrical drum (2) provided with a plurality of cylindrical boreholes distributed over the circumference thereof and containing displaceable pistons. Said cylindrical boreholes (3,4) comprise cylindrical openings (35.1, 35.2, . . . 35.9) on one side, which are temporarily connected to one of two control nodules (9, 10) according to the angle of rotation of the cylindrical drum (2), said control nodes being respectively connected to a working line (27, 28). A reversing region (30, 31) is respectively embodied between the control nodules (9, 10), a first end (32) of a pressure compensation line (33) ending in one of the reversing regions (30, 31). A second end (34) of said pressure compensation line (33) ends in the output-side working line (27), the length (L) of the output-side working line (27) between the output-side control nodules (9) and the second end (34) of the pressure compensation line (33) being measured in such a way that a defined phrase relation counteracting the pressure variation exits between a pressure wave caused by a reciprocating motion of the piston (5, 6) and continuing in the output-side working line (27), and the angle of rotation of the cylindrical drum (2).

9 Claims, 4 Drawing Sheets

U.S. PATENT DOCUMENTS

Figure 1:
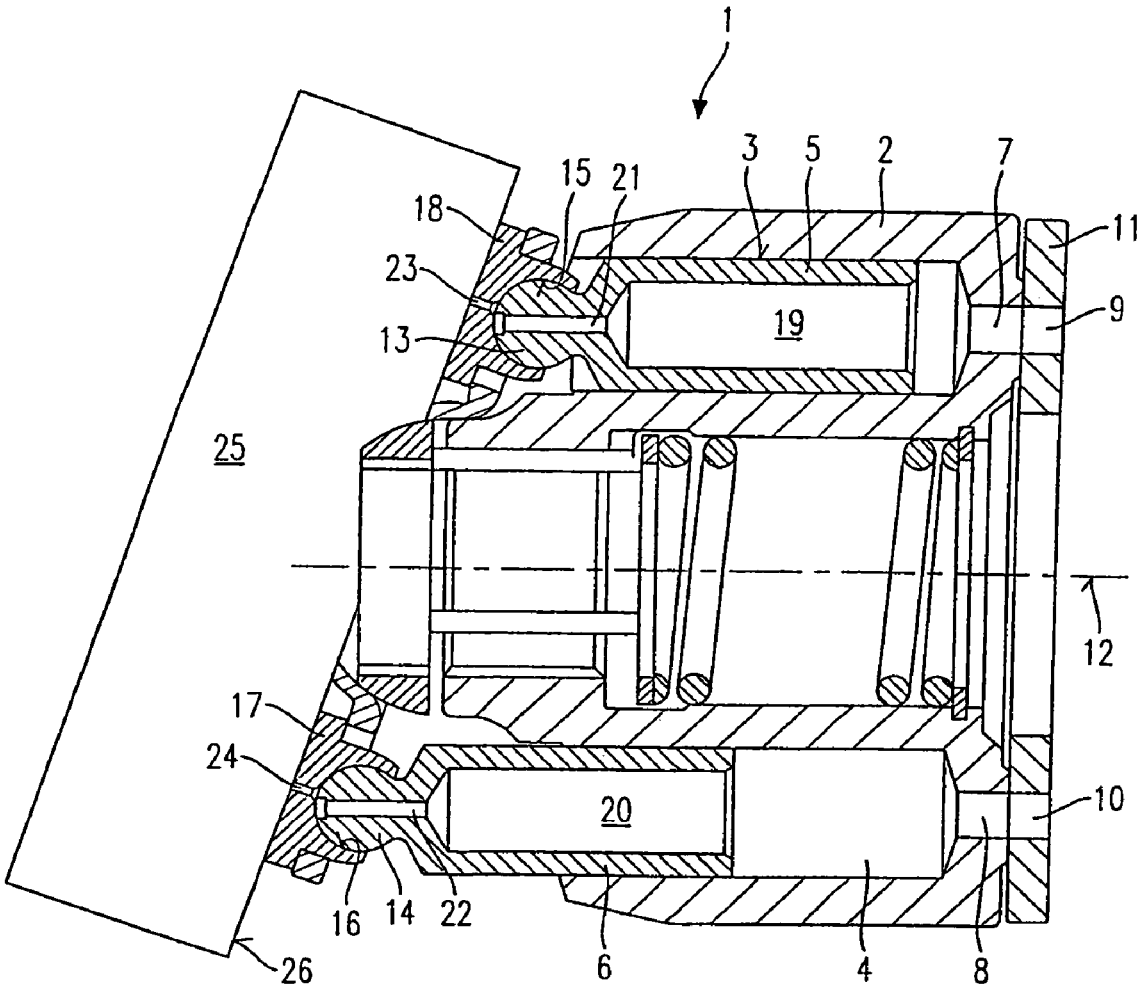

| | | | | |
|---|---|---|---|---|
| 5,507,151 | A | 4/1996 | Ring et al. | |
| 5,555,726 | A * | 9/1996 | Huebner | 60/469 |
| 5,762,479 | A | 6/1998 | Baars et al. | |
| 6,024,541 | A * | 2/2000 | Perstnev et al. | 417/269 |
| 6,112,514 | A * | 9/2000 | Burdisso et al. | 60/226.1 |
| 6,361,285 | B1 | 3/2002 | Lehner | |
| 6,364,055 | B1 * | 4/2002 | Purdy | 181/279 |
| 2002/0098093 | A1 * | 7/2002 | Tomell et al. | 417/312 |
| 2003/0026710 | A1 * | 2/2003 | Nishikawa et al. | 417/271 |

FOREIGN PATENT DOCUMENTS

| | | |
|---|---|---|
| DE | 197 06 114 | 8/1998 |
| DE | 100 34 857 | 1/2002 |

* cited by examiner

PISTON ENGINE COMPRISING A PULSATION-REDUCING DEVICE

The invention relates to a piston machine with a device for reducing flow pulsations.

When hydrostatic piston machines are in operation, their design leads to a pulsation of the pressure caused by non-uniform delivery of the employed pressure medium, which spreads out through the line system.

From DE 100 34 857 A1 a pulsation-reducing device is known, which has, opening out into the switchover region of the control level, a pressure compensation line connected to the high-pressure-side kidney-shaped control port by a controlled throttle. The controlled throttle comprises a piston having a control edge, wherein the position of equilibrium of the piston is set by means of a compression spring and, in the opposite direction, by means of a compression force, wherein the compression force is generated by the pressure prevailing in the high-pressure kidney-shaped control port. With this system, compared to conventional control notches, an improved adaptation to the respective operating state of the piston machine may be achieved.

A drawback of the previously described piston machine is that the flow pulsations, which admittedly occur only to a reduced extent but are not entirely avoidable, are transmitted to the control piston, and so the control piston in turn may be excited into oscillation. This has a direct influence on the effectiveness of the pressure compensation that is to be enabled by the variable throttle. A further drawback is that owing to the movement of the control piston, which is unavoidable because of the pulsation of the pressure in the high-pressure kidney-shaped control port, considerable wear occurs at the pulsation-reducing device.

The object of the invention is to provide a piston machine with a pulsation-reducing device that is easy and economical to realize and does not require any additional components or take up additional installation space.

The object is achieved by the piston machine having the features of claim 1.

The piston machine according to the invention has the advantage that producing a pulsation reduction entails only the provision of a pressure compensation line, which is disposed between a working line and an opening disposed in a switchover region of a control level. When arranging the pressure compensation line, it is merely necessary to take into account that the opening-out in the working line is to be provided at a point where the pressure wave advancing in the working line may be tapped in the correct phase sequence. This tapping in the correct phase sequence makes it possible, on the one hand, to achieve a pressure rise in a cylinder chamber of a piston machine being operated as a pump. On the other hand, it is equally possible, by tapping a targeted phase of the pressure wave advancing in the working line, to achieve a pressure reduction in a cylinder during sweeping-over of the switchover region when a piston machine is being operated as a motor. Thus, by simply selecting the point, at which the pressure compensation line opens out in the working line, the effect is achieved whereby for a pump the pressure maximum and for a motor, on the other hand, a pressure minimum is reduced.

The advancing pressure wave in the working line is reduced in amplitude as a result of the tapping in the correct phase sequence, with the result that the structure-borne noise transmission to downstream components and hence, ultimately, their noise radiation is reduced.

Advantageous developments of the piston machine according to the invention are possible by virtue of the measures outlined in the sub-claims.

Figure 2:
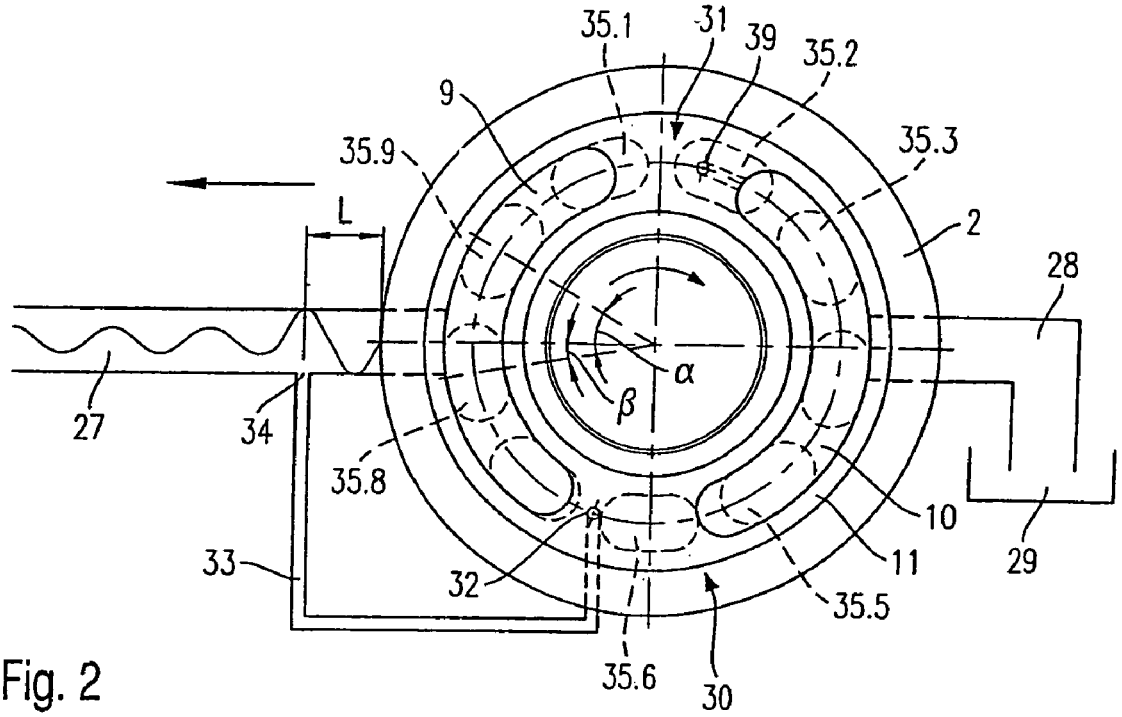
Figure 3:
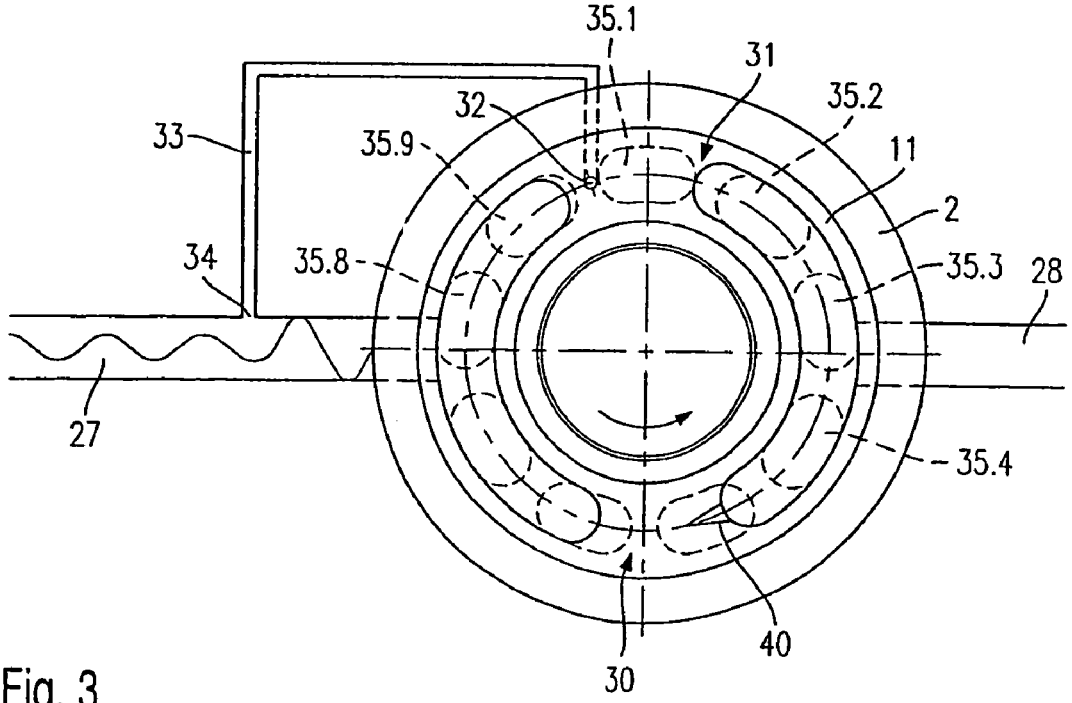
Figure 4:
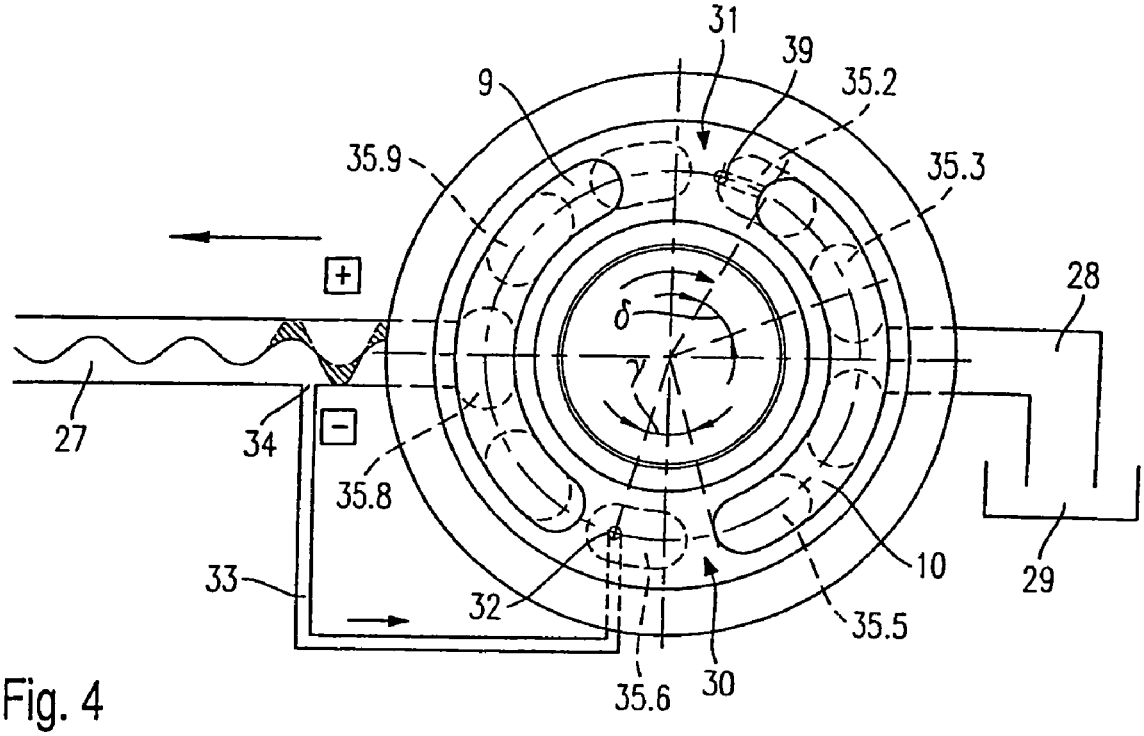
Figure 5:
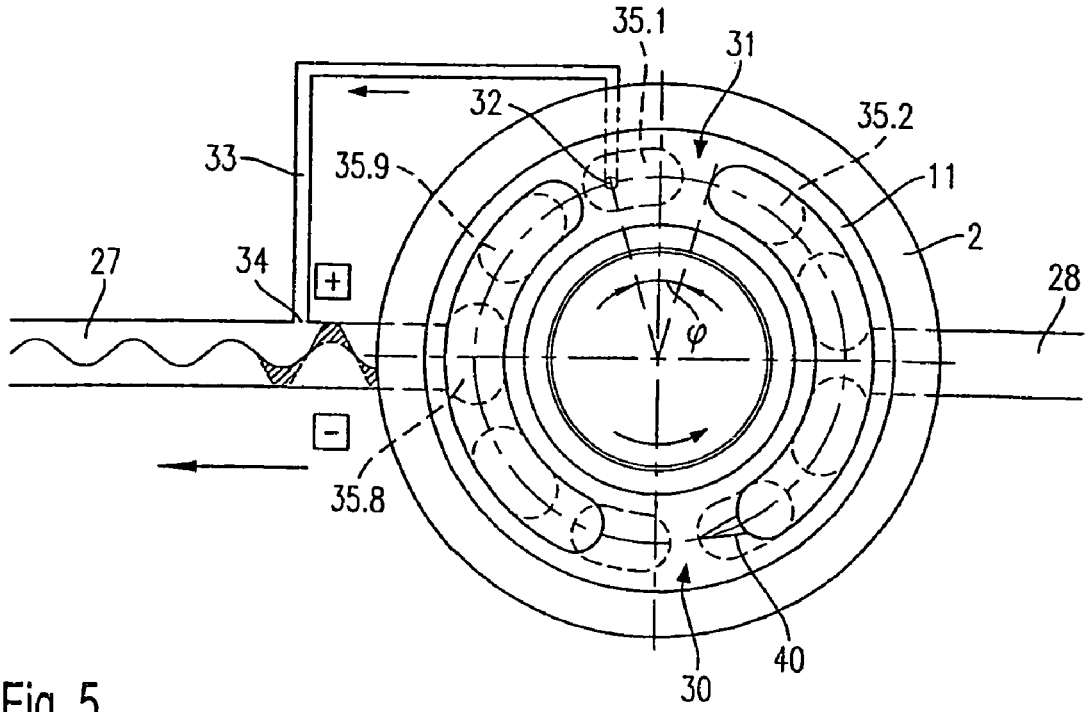
Figure 6:
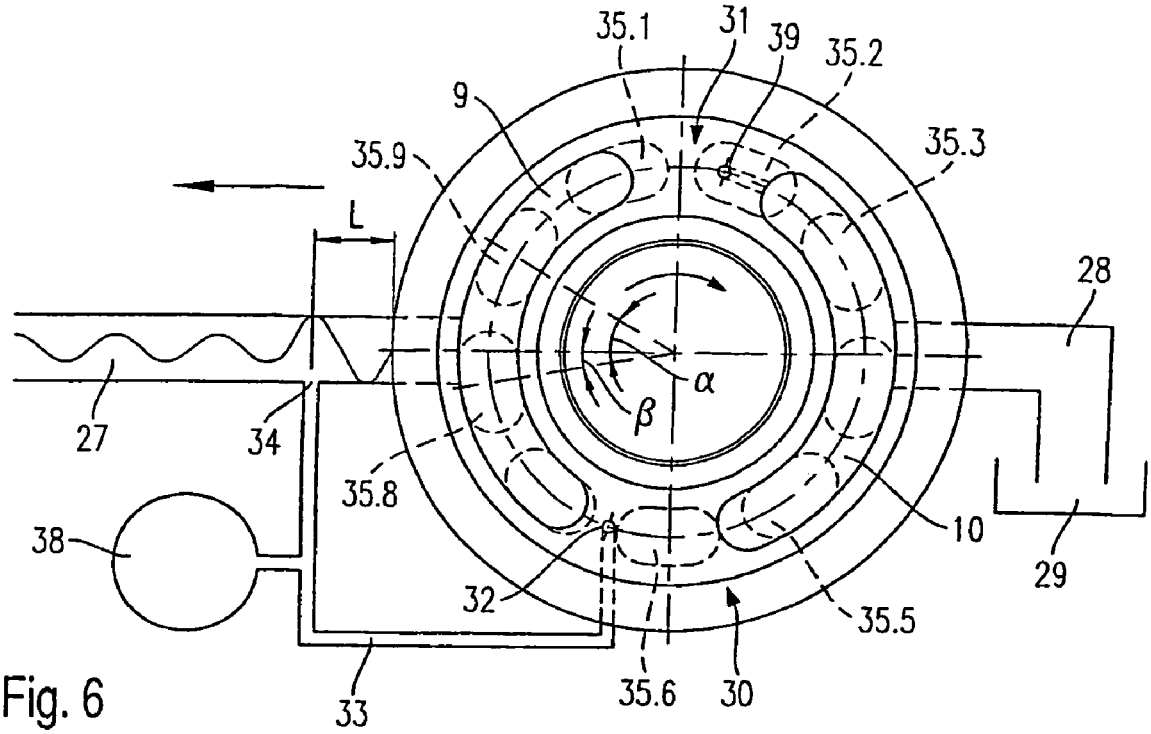
Figure 7:
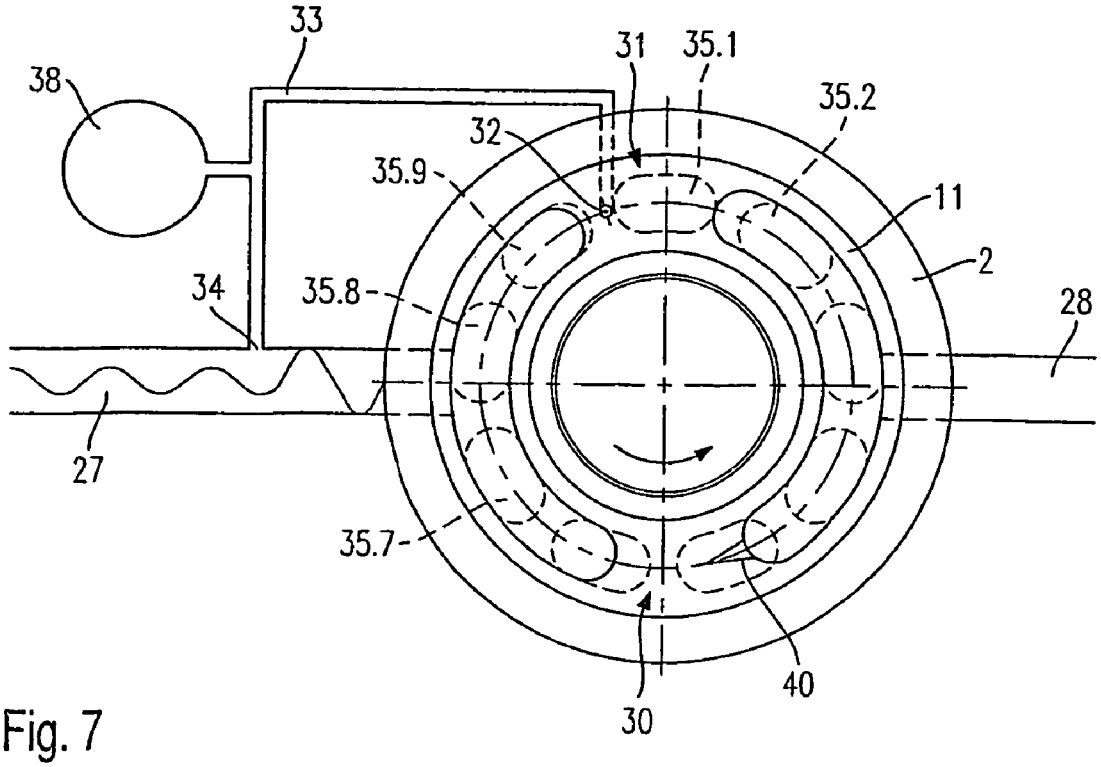

The piston machine according to the invention is diagrammatically illustrated in the drawings and described in detail below. The drawings show:

FIG. 1 a diagrammatic view of an axial piston machine according to the background art;

FIG. 2 a plan view of a control level of an axial piston machine operated as a pump;

FIG. 3 a plan view of a control level of a piston machine operated as a motor;

FIG. 4 a plan view of the control level of the axial piston machine of FIG. 1 at a later point;

FIG. 5 a plan view of the control level of the axial piston machine of FIG. 3 at a later point;

FIG. 6 a plan view of a control level of the axial piston machine of FIG. 1 with an additional pressure accumulator; and FIG. 7 a plan view of a control level of an axial piston machine of FIG. 3 with an additional pressure accumulator.

FIG. 1 shows a section through an, as such, known axial piston machine 1. A cylindrical drum 2 is disposed in the interior of a non-illustrated housing of the axial piston machine 1, wherein the cylindrical drum 2 is mounted rotatably in relation to a centre line 12. Cylindrical openings 3, 4 are provided in the cylindrical drum 2, wherein the cylindrical openings 3, 4 are disposed parallel to the centre line 12 and distributed uniformly over the circumference. Disposed in the cylindrical bores 3, 4 are pistons 5, 6, which are mounted displaceably in the cylindrical openings 3, 4.

The cylindrical bores 3, 4 at a front end of the cylindrical drum 2 each have a cylindrical opening 7, 8, wherein during rotation of the cylindrical drum 2 the cylindrical openings 7, 8 sweep successively over a first kidney-shaped control port 9 and a second kidney-shaped control port 10, wherein the kidney-shaped control ports 9, 10 are disposed in a control level 11, which is connected to the housing of the axial piston machine 1 so as to be locked against rotation. The kidney-shaped control ports 9, 10, which extend along a segment of a circle, are each connected to a working line that is not shown in FIG. 1.

At their ends remote from the kidney-shaped control ports 9, 10 the pistons 5, 6 each have an approximately spherical extension 13, 14, the spherical geometry of which corresponds with a recess 15, 16 of a sliding block 17, 18.

In the illustrated embodiment the sliding blocks 17, 18 are supported on a swash plate 25. In order to supply the contact surface between the sliding blocks 17, 18 and the swash plate 25 with lubricant, both the spherical extensions 14, 13 and the sliding blocks 17, 18 have a pressure oil bore 21, 22 and 23, 24 respectively. Thus, from the pressure medium reservoir both the contact points between the sliding blocks 17, 18 and the swash plate 25 and between the spherical heads 13, 14 and the corresponding recesses 15, 16 of the sliding blocks 17, 18 are adequately lubricated.

For operation as an axial piston pump, the cylindrical drum 2 is rotated about its centre line 12, wherein because of the inclination of the swash plate 25 in relation to the centre line 12 the pistons 5, 6 disposed in the cylindrical drum 2 execute a reciprocating motion, wherein they are connected during an intake reciprocating motion to a low-pressure kidney-shaped control port, during a high-pressure reciprocating motion, on the other hand, to a high-pressure kidney-shaped control port.

FIG. 2 shows a plan view of a control level 11 of an axial piston pump, wherein the direction of rotation of the cylindrical drum 2 is indicated by an arrow. The cylindrical drum 2 has nine cylindrical bores, which are distributed uniformly over its circumference and the cylindrical openings of which are illustrated by dashes and denoted by the reference characters 35.1 to 35.9 in FIG. 2. In the control level 11 a high-pressure kidney-shaped control port 9 is disposed as a first kidney-shaped control port and an intake kidney-shaped control port 10 is disposed as a second kidney-shaped control port. Disposed between the kidney-shaped control port 9 and the kidney-shaped control port 10 there is in each case a region, in which the cylindrical openings 35.1 to 35.9 have contact neither with the one nor with the other kidney-shaped control port 9, 10. These regions are referred to as switchover region 30 and switchover region 31 respectively.

In the switchover region 30, which is swept over by the cylindrical openings 35.1 to 35.9 during the change from the low-pressure to the high-pressure side, an opening is disposed, which forms a first end 32 of a pressure compensation line 33. The pressure compensation line 33 has a second end 34, which opens into a working line 27. The axial piston machine 1 illustrated in FIG. 2 takes in pressure medium from a tank volume 29 through a working line 28 and conveys it, as indicated by the arrow, into the working line 27.

During operation of an axial piston machine 1, the finite number of pistons 3, 4 and the non-uniform velocity profile during a pump lift lead to irregularities in the flow rate. These irregularities in the flow rate result in a pressure pulsation of the kind illustrated diagrammatically in the working line 27. Starting from the high-pressure kidney-shaped control port 9, a pressure wave advances along the working line 27. A length L of the working line 27 between the high-pressure kidney-shaped control port 9 and the second end 34 of the pressure compensation line 33 is in said case so dimensioned that the advancing pressure wave in the working line 27 at the moment, at which the second end 34 of the pressure compensation line 33 presents a maximum, at which the first end 32 in the switchover region 30 comes into contact with a further cylindrical opening.

In the illustrated embodiment, the cylindrical opening 35.6 is the next to come into overlap with the opening at the first end 32 of the pressure compensation line 33. If at the instant, when the cylindrical opening 35.6 overlaps the opening of the first end 32 of the pressure compensation line 33, at the second end 34 of the pressure compensation line 33 there is a pressure maximum in the working line 27, then a pressure compensation occurs, in which the pressure in the cylindrical bore connected to the cylindrical opening 35.6 is increased via the pressure compensation line 33. Because of the pressure medium flowing into the pressure compensation line 33, the amplitude of the pressure wave advancing in the working line 27 is subsequently reduced. A pressure pulsation reduction is therefore achieved.

In the following, the function is illustrated merely schematically with reference to an example that does not limit the generality.

In the illustrated embodiment having nine bores in the cylindrical drum 2, given the illustrated arrangement of the first end 32 of the pressure compensation line 33, at the instant when the overlap between the opening at the first end 32 of the pressure compensation line 33 and the cylindrical opening 35.6 begins, the ratio of the angles $\alpha$, $\beta$, which the cylindrical openings 35.9 and 35.8 form with the centre line of the working line 27, is 1:4. A pressure maximum in the working line 27 occurs whenever a cylindrical opening 35.1 to 35.9 forms with the centre line of the working line 27 a specific angle, which recurs cyclically in accordance with the number of pistons per revolution. Accordingly, at the illustrated instant the pressure maximum in the working line 27 has advanced from the side of the high-pressure kidney-shaped control port 9 by approximately ¼ of wavelength $\lambda$.

This therefore produces, for the illustrated preferred case of nine cylinder bores arranged so as to be uniformly distributed over a cylindrical drum 2, a length L between the high-pressure kidney-shaped control port 9 and the second end 34 of the pressure compensation line 33 that is equal to ¼ $\lambda$. The wavelength $\lambda$ in said case arises from the frequency of the pulsations, which in turn may be determined from the number of cylindrical bores and the rotational speed of the cylindrical drum 2. In order to relieve a residual pressure, a connection channel 39 moreover opens out into the switchover region 31, the second end of said channel opening into the kidney-shaped control port 10.

FIG. 3 illustrates a corresponding device for an axial piston machine 2, which is being operated as a hydraulic motor. Through the working line 28 a high pressure, which is generated e.g. by the axial piston machine illustrated in FIG. 2, is supplied to the hydraulic motor. The direction of rotation is anticlockwise, as denoted by the arrow. When the cylindrical openings 35.1 to 35.9 sweep over the switchover region 31, the high pressure in the cylindrical bore generated by the filling on the high-pressure side is relieved via the pressure compensation line 33 in part into the working line 27. The second end 34 of the pressure compensation line 33 is in said case so connected to the working line 27 that at the instant, when the cylindrical opening 35.1 comes into contact with the opening at the first end 32 of the pressure compensation line 33, there is a pressure minimum at the second end 34 of the pressure compensation line 33. The partial equalization between the pressure in the cylinder and the pressure in the working line 27 leads once more, as already described in detail above for the example of an axial piston pump, to a reduction of the amplitude of the pressure variations in the working line 27 and hence to a reduced noise radiation of the components subsequently connected to the working line. Furthermore, for a slow pressure build-up a pilot notch 40 is formed, in direction of rotation, in front of the kidney-shaped control port 10.

FIG. 4 shows the axial piston machine 2 of FIG. 2 once more, at a later moment. The pressure wave propagating in the working line 27 has, in accordance with the angle of rotation of the cylindrical drum 2, advanced by ¾ $\lambda$, wherein at the end of the working line 27 oriented towards the high-pressure kidney-shaped control port there is accordingly a pressure maximum, which is caused by the piston associated with the cylindrical opening 35.8. This pressure maximum arising at the start of the working line 27 moves at the speed of sound along the working line 27, wherein it has to have arrived at the second end 34 of the pressure compensation line 33 at the instant when, in the direction of rotation, the next cylindrical opening 35.5 has come into overlap with the opening at the first end 32 of the pressure compensation line 33.

From the remaining angle of rotation $\gamma$ between the cylindrical opening 35.5 and the opening at the first end 32 of the pressure compensation line 33 in relation to the intermediate angle $\delta$ between two successive cylindrical openings, e.g. 35.2 and 35.3, the minimum distance between the second end 34 of the pressure compensation line 33 and the high-pressure kidney-shaped control port 9 arises in units of the wavelength $\lambda$ in accordance with previously mentioned definitions. If it is impossible to connect the second end 34 of the pressure compensation line 33 to the point of the working line 27 thus calculated, then a connection point of an identical effect, displaced in each case by $\lambda$, is possible.

FIG. 5 shows the corresponding case for the axial piston machine of FIG. 3, at a later moment. In the illustrated example, the remaining angle $\phi$, through which the cylinder with the cylindrical opening 35.2 has to travel to reach the opening at the first end 32 of the pressure compensation line 33, is to be taken as a basis. The minimum distance between the mouth opening at the second end 34 of the pressure compensation line and the outlet kidney-shaped control port 9 of the axial piston machine 1 is therefore determined from the quotient of the remaining angle $\phi$ and the intermediate angle $\delta$ between two successive cylindrical openings 35.2 and 35.3, wherein owing to the tapping of the pressure minimum, in contrast to the case previously described for a pump, a displacement by $\lambda/2$ has to be taken into account.

When determining the length L, account may be taken of the fact that a pressure variation propagating in the working line 27 likewise has a propagation time along the pressure compensation line 33. In said case, an altered phase position has to be taken into account, in that the phase displacement along the pressure compensation line is considered as a change in length of the length L.

FIGS. 6 and 7 show two further embodiments of pulsation-reducing devices according to the invention, wherein in each case, in addition to the already explained pulsation reduction by tapping a pressure variation in the working line 27 in the correct phase sequence, an accumulator element 38 is provided. With the aid of the accumulator element 38 it is additionally possible to enlarge the operating range, within which the pulsation reduction is effective. Alternatively, a defined cross-sectional area may be providable at the second end 34, at the point where the pressure compensation line 33 opens out into the working line 27.

The invention claimed is:

1. Piston machine comprising a rotatably mounted cylindrical drum (2), disposed in which is a plurality of cylindrical bores (3, 4), which are distributed over the circumference and in which displaceable pistons (5, 6) are disposed, wherein the cylindrical bores (3, 4) at one side have cylindrical openings (7, 8, 35.1, 35.2, . . . 35.9), which in accordance with the angle of rotation of the cylindrical drum (2) are temporarily in communication in each case with one of two outlet-side kidney-shaped control ports (9, 10), which are connected in each case to an outlet-side working line (27, 28), wherein between the kidney-shaped control ports (9, 10) there is formed, in each case, a switchover region (30, 31) and wherein a first end (32) of a pressure compensation line (33) opens out at least into one switchover region (30, 31), wherein a second end (34) of the pressure compensation line (33) opens into the outlet-side working line (27), wherein the length (L) of the outlet-side working line (27) between the one said outlet-side kidney-shaped control port (9) and the second end (34) of the pressure compensation line (33), in the case of a hydraulic pump, is so dimensioned that the advancing pressure wave in the working line (27) at the moment at which a pressure maximum reigns at the second end of the pressure compensation line, the first end (32) in the switchover region (30) comes into contact with a further cylindrical opening and a pressure medium flows from the working line over the pressure compensation line into the further cylindrical opening, and/or that the length in the case of a hydraulic motor is so dimensioned that the instant, when the further cylindrical opening (35.1) comes into contact with the opening at the first end (32) of the pressure compensation line (33), a pressure minimum prevails at the second end (34) of the pressure compensation line (33), wherein at the moment at which the first end in the switchover region comes into contact with said further cylindrical opening, the cylindrical opening has no direct contact with the outlet-side kidney-shaped control port.

2. Piston machine according to claim 1, wherein the piston machine is a hydraulic pump and that the length (L) between the outlet-side kidney-shaped control port (9) and the second end (34) of the pressure compensation line is approximately ¼ $\lambda$, wherein $\lambda$ signifies the wavelength of the pressure wave and selectively, additionally an integral multiple of the wavelength ($\lambda$) of the pressure wave.

3. Piston machine according to claim 1, wherein the piston machine is a hydraulic motor and that the length (L) between the outlet-side kidney-shaped control port (9) and the second end (34) of the pressure compensation line is approximately ¾ $\lambda$, wherein $\lambda$ signifies the wavelength of the pressure wave and selectively, additionally an integral multiple of the wavelength ($\lambda$) of the pressure wave.

4. Piston machine according to claim 1, wherein the piston machine operates as a hydraulic pump and that the length (L) of the outlet-side working line (27) between the outlet-side kidney-shaped control port (9) and the second end (34) of the pressure compensation line (33) is a fraction of the wavelength ($\lambda$), wherein the fraction corresponds approximately to the quotient of the angle ($\gamma$) between the first end (32) of the pressure compensation line (33) and the cylindrical opening (35.5) of the next cylinder to come into overlap with the first end (32) of the pressure compensation line (33) at the instant that there is an occurrence of a pressure maximum in the outlet-side working line (27) and if the intermediate angle ($\delta$) between two adjacent cylindrical bores and, selectively, additionally an integral multiple of the wavelength ($\lambda$) of the pressure wave.

5. Piston machine according to claim l, wherein the piston machine operates as a hydraulic motor and the length (L) of the outlet-side working line (27) between the outlet-side kidney-shaped control port (9) and the second end (34) of the pressure compensation line (33) is a fraction of the wavelength ($\lambda$), wherein the fraction corresponds approximately to the quotient of the angle ($\delta$) between the first end (32) of the pressure compensation line (33) and the cylindrical opening (35.2) of the next cylinder to come into overlap with the first end (32) of the pressure compensation line (33) at the instant of occurrence of a pressure minimum and of the intermediate angle ($\delta$) between two adjacent cylindrical bores and, selectively, additionally an integral multiple of the wavelength ($\lambda$) of the pressure wave.

6. Piston machine according to any one of claims 1 to 5, wherein the length of the pressure compensation line (33) is an integral multiple of the wavelength ($\lambda$) of the pressure wave.

7. Piston machine according to any one of claims 1 to 5, wherein the phase displacement caused by the length of the pressure compensation line (33) at the first end (32) is taken into account by means of a correction-of the length (L) between the outlet-side kidney-shaped control port (9) and the second end (34) of the pressure compensation line (33).

8. Piston machine according to claim 1, wherein a pressure accumulator element (38) is connected to the pressure compensation line (33).

9. Piston machine according to claim 1, wherein a throttling point is formed at the second end (34) of the pressure compensation line (33).

* * * * *